US006810227B2

(12) United States Patent
Sakata et al.

(10) Patent No.: US 6,810,227 B2
(45) Date of Patent: Oct. 26, 2004

(54) FOAMED ELASTIC MEMBER FOR USE IN IMAGE FORMING APPARATUS

(75) Inventors: Junji Sakata, Kodaira (JP); Hirotaka Yamazaki, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 10/303,999

(22) Filed: Nov. 26, 2002

(65) Prior Publication Data

US 2003/0147676 A1 Aug. 7, 2003

(30) Foreign Application Priority Data

Nov. 27, 2001 (JP) ..... 2001-361248
Dec. 28, 2001 (JP) ..... 2001-398812

(51) Int. Cl.[7] ..... G03G 15/08

(52) U.S. Cl. ..... 399/281; 492/18; 492/30; 492/36

(58) Field of Search ..... 399/279, 281, 399/286; 492/18, 31, 33, 35, 36

(56) References Cited

U.S. PATENT DOCUMENTS 5,086,728 A * 2/1992 Kinoshita ..... 399/281
5,424,813 A * 6/1995 Schlueter et al. ..... 399/239
5,655,197 A * 8/1997 Okada et al. ..... 399/281
5,768,668 A * 6/1998 Shiraki et al. ..... 399/281
5,930,570 A * 7/1999 Saito et al. ..... 399/279
6,149,564 A * 11/2000 Nozawa et al. ..... 492/30
6,480,692 B2 * 11/2002 Yamazaki et al. ..... 399/281

* cited by examiner

*Primary Examiner*—Robert Beatty
(74) *Attorney, Agent, or Firm*—Sughrue Mion, PLLC

(57) ABSTRACT

A foamed elastic member according to the invention comprises an elastic member made of polyurethane foam molded by an in-mold foaming process, and has properly determined physical properties of its surface and/or properly determined shape and arrangement of foam cells opened on the surface. The foamed elastic member is suitably used for a toner feed roller in a developing device for electrically charging toner from a toner storage portion, feeding the toner onto the surface of a photosensitive member and forming a toner image corresponding to an electrostatic latent image on the surface of the photosensitive member. In this case, it exhibits an excellent toner scraping and toner feeding performance, to form an image free from such defect as irregularity in pitch and density, or free from reduction in density.

37 Claims, 5 Drawing Sheets

FOAMED ELASTIC MEMBER FOR USE IN IMAGE FORMING APPARATUS

BACKGROUND OF THE INVENTION

1. Field of the Invention

The present invention relates to an elastic member for use in electrophotographic process or the like, and also to an image forming apparatus using the same.

2. Related Art

In electrophotographic apparatus such as electronic copy machine, laser beam printer, facsimile machine or the like, a developing process is performed by a developing device of the type wherein toner is frictionally electrified by rubbing a toner feed roller against a developing roller. Therefore, it is necessary for a toner feed roller to have a stable frictional ability with a developing roller and a high toner feeding ability to a frictional part. At the same time, it is also required for the toner feed roller to have the ability of scraping away excessive toner that remains on the developing roller without being used for development. From such viewpoint, an elastic material made of foamed rubber, polyurethane or the like, has been used up to present, for a toner feed roller of such a type.

However, there is an instance wherein a toner feed roller made of conventional foamed elastic material produces defects due to irregular pitch or irregular density on the developed image. Such defects are caused when the toner is insufficiently or unevenly supplied by the toner feed roller, or when the toner is insufficiently or unevenly scraped away, and may produce indistinct image due to reduction in density of the image, for example.

Consequently, there is a demand for a foamed elastic member that can be suitably used in an electrophotographic apparatus, particularly as a toner feed roller, for achieving an image free from defects such as pitch irregularity, density irregularity or the like, or free from reduced density.

SUMMARY OF THE INVENTION

It is a primary object of the present invention to provide a foamed elastic member suitable for use in an electrophotographic apparatus, particularly as a toner feed roller, capable of providing an image free from such defect as pitch irregularity, density irregularity or the like, or free from reduction in density.

In order to achieve the object, the inventors conducted thorough investigations on a toner feed roller that has produced defective image as described above, and found the following. That is to say, when a high-density image such as a black solid image is printed immediately after a low-density image such as a white solid image has been printed, an irregularity in density occurs such that the leading end of the printed black solid image is higher in density than the trailing end of the printed image. It is noted that, in the case of white solid printing, the amount of toner carried from a developing roller to a photosensitive member is small and the amount of the toner remaining on the developing roller is large, with the result that the toner is liable to be insufficiently scraped away by a toner feed roller and the amount of residual toner on the developing roller is gradually increased. Therefore, the irregularity in density is caused when a black solid image is printed immediately after a white solid image is printed, resulting in a higher density of an image printed by one to two rotations of the developing roller as compared to the density of the trailing end of the printed image, or when the amount of toner supplied to the developing roller by the third to fourth rotations of the developing roller corresponding to the hind part of the printed image is insufficient as compared to the toner amount supplied by the first to second rotations of the developing roller.

The present invention has been achieved based on a conception that, when a foamed elastic material obtained by foaming rubber, polyurethane or the like is used as a toner feed roller, in order to exhibit excellent performance of feeding toner and performance of scraping toner away to thereby form an image free from defect, it is important to properly determine physical property values at the surface of the foamed elastic material and/or to properly determine the shape and arrangement of the foam cells opening at the surface of the foamed elastic material.

According to a first aspect of the present invention, there is provided a foamed elastic member for use in an electrophotographic process or the like, comprising an elastic member made of polyurethane foam molded by an in-mold foaming process, and having a plurality of openings regularly arranged on the surface of the polyurethane foam, each of said openings having a basic shape approximate to a circle, ellipse, racetrack, triangle, tetragon or hexagon.

Since the polyurethane-foam elastic member as described has properly determined shape and arrangement of the foam cells that are opened on its surface, it particularly advantageously exhibits excellent toner feeding performance and toner scraping performance when used as a toner feed roller in a developing device for electrically charging toner from a toner storage portion, feeding the toner to the surface of a photosensitive member and forming a toner image corresponding to an electrostatic latent image on the surface of the photosensitive member.

The inventors conducted further investigations and found that it is possible to form an image free from defect by improving the toner feeding performance and the toner scraping-away performance of a toner feed roller when optimization is made of such parameters as the average opening diameter of the foam cells opened at the surface of a foamed elastic member forming the toner feed roller (i.e., "average cell opening diameter"), the ratio of the area of openings of the foam cells to the surface area of the foamed elastic member (i.e., "cell opening ratio"), the compression spring constant and the restoring ratio of elasticity after compression of a skin layer in the vicinity of the surface of the foamed elastic member, as well as the coefficient of friction of the surface of the foamed elastic member, etc.

According to a second aspect of the present invention, there is provided a polyurethane-foam elastic member molded by an in-mold foaming process, and satisfying the following conditions:

(A) the average opening diameter at the surface of the foamed elastic member is 50 to 300 $\mu$m, (B) the ratio of the total area of the openings to the surface area of the foamed elastic member is 50 to 80%, (C) the compression spring constant of the foamed elastic member is 0.25 to 1.5 N/mm, (D) the restoring ratio of elasticity after compression of the foamed elastic member is 60% or more, and (E) the coefficient of friction of the surface of the foamed elastic member is 0.4 to 3.0.

Since the polyurethane-foam elastic member as described above has properly determined physical property values at its surface are, it particularly advantageously exhibits excellent toner feeding performance and toner scraping performance when used as a toner feed roller in a developing device for electrically charging toner from a toner storage portion, feeding the toner to the surface of a photosensitive member and forming a toner image corresponding to an electrostatic latent image on the surface of the photosensitive member.

BRIEF DESCRIPTION OF THE DRAWINGS

Some preferred embodiments of the present invention will be described below with reference to the accompanying drawings.

DETAILED DESCRIPTION OF THE PREFERRED EMBODIMENTS

Figure 1:
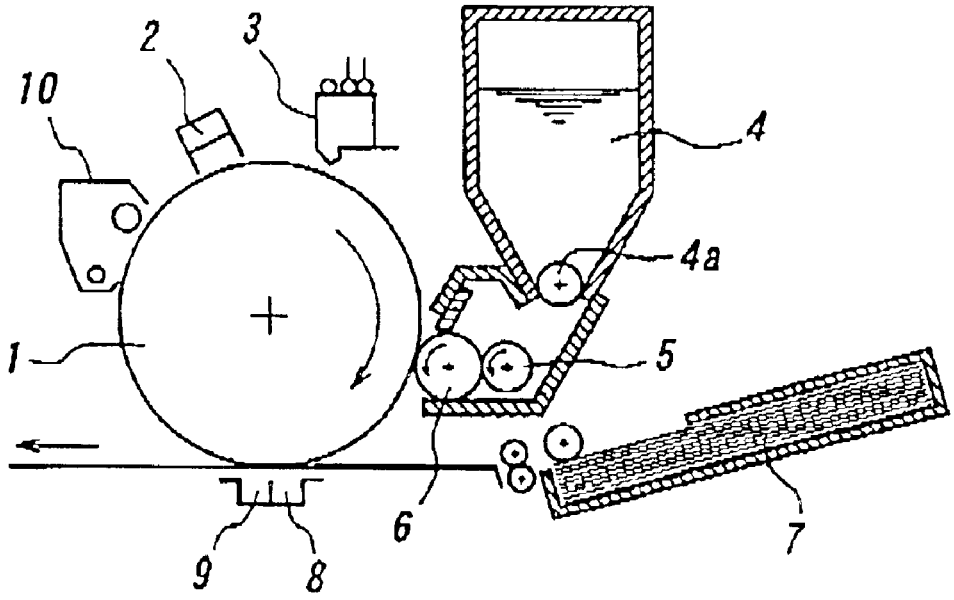
FIG. 1 is a schematic diagram showing a developing part of a laser printer as an example of a developing device according to the present invention.

FIG. 1 shows a laser printer provided with a developing device that is comprised of a toner storage portion containing toner as a developer, a toner feed roller and a developing roller, for forming a toner image by feeding toner to an electrostatic latent image on the surface of a photosensitive member. A foamed elastic member according to the present invention can be applied to a toner feed roller in such a developing device.

With reference to FIG. 1, the surface of the photosensitive member 1 is uniformly charged electrically by means of a primary charger 2, and the image signal transmitted from a control portion is converted into an optical signal by means of an LED array print head 3, so as to expose the surface of the photosensitive member 1 with the optical signal and thereby form an electrostatic latent image. The electrostatic latent image is developed with toner to form a toner image. The toner is stored in a toner cartridge 4 having an adjusting roller 4*a* for adjusting the amount of toner to be discharged from the bottom thereof, and is supplied to the photosensitive member 1 through a toner feed roller 5 and a developing roller 6 so as to form a toner image.

During the time period wherein a sheet of paper supplied from a paper magazine 7 is carried and discharged in the direction of arrow, the toner image formed on the surface of the photosensitive member 1 is transferred to the surface of the paper by a transfer charger 8 and is then fixed by a thermal fixing unit 9. The photosensitive member 1 which has been subjected to a transfer process is returned to the initial state by a cleaning unit 10.

Figure 2A:
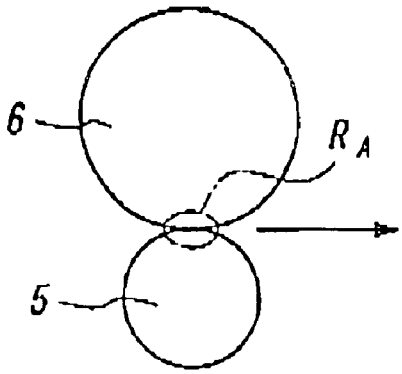
FIGS. 2A and 2B are explanatory views showing the states of toner as being friction-electrified by a toner feed roller.
Figure 2B:
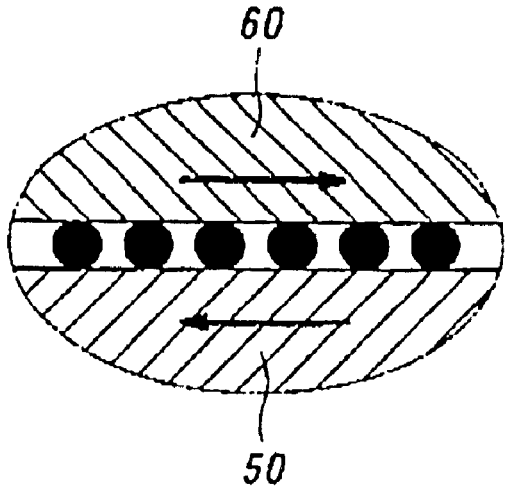

FIG. 2A is an explanatory view showing the state of toner electrically friction-charged by the toner feed roller 5, and FIG. 2B is a magnified view of a part indicated by symbol $R_A$ of FIG. 2A. An abutted portion 50 of the toner feed roller 5 against the developing roller 6 and an abutted portion 60 of the developing roller 6 against the toner feed roller 5 are moved in the directions of arrows opposite to each other. Accordingly, toner particles (designated by black spots "*") put between the abutted portions 50 and 60 of both rollers 5 and 6 are cause to slip on the abutted portion 60 in the opposite direction to the direction of progress by a frictional force with the abutted portion 50, and are thereby electrically friction-charged. That is to say, toner is electrically charged by the slipping that occurs between the toner and the abutted portion 60, and the charged toner is supplied onto the developing roller. In this instance, when the toner feed roller has a proper friction coefficient with toner, a toner frictional force (i.e., the toner holding ability) is improved and a toner feeding operation and a toner charging operation are performed with minimized damages to the toner, and it is thus possible to perform development without causing defects in the image.

Figure 3A:
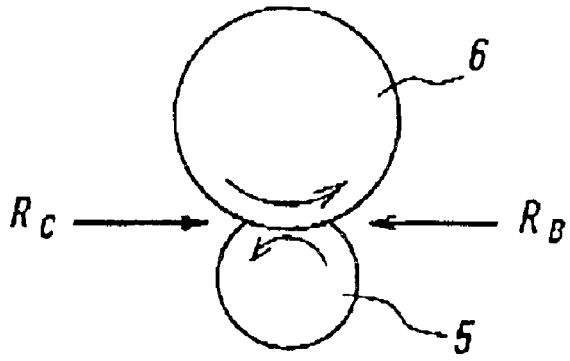
FIGS. 3A, 3B and 3C are explanatory views showing the states of toner as being supplied and scraped away by a toner feed roller according to the present invention.
Figure 3B:
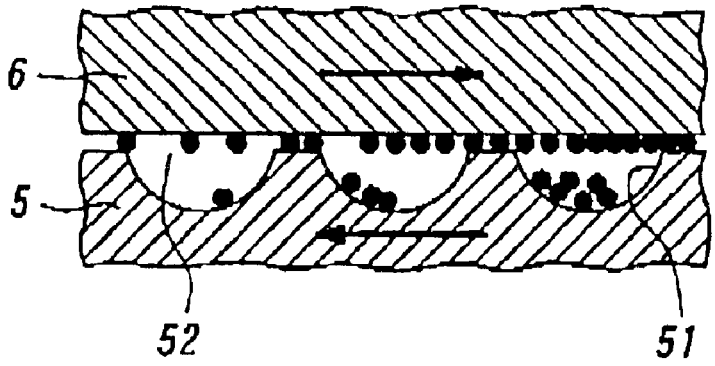
Figure 3C:
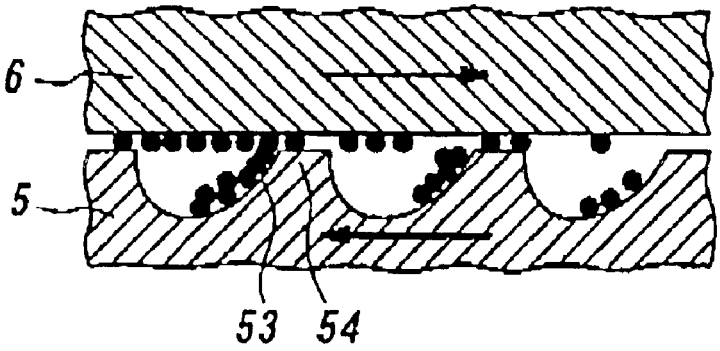

FIGS. 3A, 3B and 3C are explanatory views showing the states of toner supplied and scraped away by the toner feed roller 5, wherein FIG. 3B is a magnified view of a toner feeding area shown by symbol $R_B$ of FIG. 3A, and FIG. 3C is a magnified view of a toner scraping area shown by symbol $R_C$ of FIG. 3A. In the toner feeding area of FIG. 3B, toner carried by an opening foam cell 51 in the outermost layer of the toner feed roller 5 is discharged from the opening 52 of the opening foam cell 51 and supplied onto the developing roller 6. In the toner scraping area of FIG. 3C, toner remaining on the developing roller 6 is scraped away by an edge part 53 of an opening foam cell in the outermost layer of the toner feed roller 5 and the surface 54 of the outermost layer positioned between the foam cells. The scraped toner is caused to fly by a restoring force when the edge part 53 is released, and is uniformly stirred and mixed with toner in the toner storage vessel.

The present invention is based on a conception that a toner feeding performance is improved by optimizing the average foam cell diameter of a foamed elastic member forming such a toner feed roller, the cell opening diameter and the cell opening ratio of the opening foam cells in the outermost layer of the foamed elastic member, and further a toner scraping-away performance is improved by optimizing the compression spring constant and the restoring ration of elasticity after compression of the surface of the foamed elastic member, thereby making it possible to perform development without producing image defects.

The average opening diameter of foam cells opened in the surface (or outer circumferential part) of the foamed elastic member forming a toner feed roller according to the present invention is 50 to 300 $\mu$m, preferably 50 to 250 $\mu$m. If the average cell opening diameter is less than 50 $\mu$m, toner cannot be sufficiently supplied to a developing roller. On the other hand, if it is larger than 300 $\mu$m, a problem occurs that the amount of toner supplied to the developing roller is made irregular. The ratio of the total area of openings of foam cells to the surface area of the foamed elastic member forming a toner feed roller is 50 to 80%, preferably 55 to 75%. If the cell opening ratio is less than 50%, toner cannot be sufficiently supplied to the developing roller. On the other hand, if it exceeds 80%, a problem occurs that toner remaining on the developing roller cannot be sufficiently scraped away. The average cell opening diameter and the cell opening ratio are ordinarily measured by photography.

Furthermore, in a toner feed roller according to the present invention, the compression spring constant is preferably 0.25 to 1.5 N/mm, more preferably 0.25 to 1.2 N/mm, and particularly preferably 0.25 to 1.0 N/mm. If the compression spring constant is less than 0.25 N/mm, a problem occurs that toner cannot be sufficiently friction-charged. On the other hand, if it exceeds 1.5 N/nun, a problem occurs that damage to toner is made large. The restoring ratio of elasticity after compression of the foamed elastic member is preferably not less than 60%, and more preferably not less than 70%. If the restoring ration of elasticity after compression is less than 60%, a problem occurs that the toner remaining on the developing roller cannot be sufficiently scraped away. The coefficient of friction of the surface of the foamed elastic member is preferably 0.4 to 3.0, and more preferably 0.8 to 3.0. If the coefficient of friction is less than 0.4, a problem occurs that the slippage is too large to effectively carry toner. On the other band, if it exceeds 3.0, a problem occurs that the damage to toner is made large and therefore toner is liable to be deteriorated. These compression spring constant, restoring ratio of elasticity after compression and coefficient of friction are measured by methods to be described hereinafter.

A foamed elastic member forming the toner feed roller according to the present invention may suffice provided that the above-mentioned features are satisfied. Thus, for example, there may be listed such foamed rubber materials as ester-based polyurethane foam, ether-based polyurethane foam, nitrile rubber, ethylene propylene rubber, ethylene propylene diene rubber, styrene butadiene rubber, butadiene rubber, isoprene rubber, natural rubber, silicone rubber, acrylic rubber, chloroprene rubber, butyl rubber, epichlorohydrin rubber or the like. Particularly preferred are ester-based polyurethane foam, ether-based polyurethane foam, nitrile rubber foam, ethylene propylene rubber foam, ethylene propylene diene rubber foam, silicone rubber foam or the like. They may be used alone or combined with each other to form a foamed elastic member obtained. In order to control the coefficient of friction of the foamed elastic member, either the above-mentioned foam materials may be mixed with silicone oil, or silicone oil may be applied to the surface of a foamed elastic member made of such foam materials.

The toner feed roller according to the present invention may be electrically conductive, and may be made by forming a conductive foamed elastic layer outside a metal shaft having enriched conductivity or the like, similar to a conventional conductive toner feed roller. The metal shaft may be formed by plating a shaft of steel, such as sulfuric free-cutting steel or the like, with zinc or the like, or may be comprised of aluminum, stainless steel, phosphor bronze steel or the like. The conductive foamed elastic layer may be comprised of a suitable foamed elastic material afforded with conductivity by addition of a conductive agent.

The conductive agent to be added for affording conductivity to a foamed elastic material mat be comprised of an ion conductive agent or an electronic conductive agent. As examples of an ion conductive agent, there may be listed ammonium salt such as perchlorate, chlorate, hydrochlorate, bromate, iodate, hydrofluoroborate, sulfate, ethyl sulfate, carboxylate, sulfonate or the like of tetraethylammonium, tetrabutylammonium, dodecyl trimethylammonium, (e.g., lauryl trimethylammonium), hexadecyl trimethylammonium, octadecyl trimethylammonium (e.g., stearyl trimethylammonium), denatured fatty acid dimethylaulmonium or the like, and perchlorate, chlorate, hydrochlorate, bromate, iodate, hydrofluoroborate, trifluoromethyl sulfate, sulfonate or the like of such alkali metal or alkali-earth metal such as lithium, sodium, potassium, calcium, magnesium or the like.

As examples of an electronic conductive agent, there may be listed conductive carbon such as ketene black, acetylene black or the like; such carbon for rubber as SAF, ISAF, HAF, FEF, DPF, SRF, FT, MT, etc.; carbon for ink on which an oxidation process is performed, carbon pyrolisate, natural graphite, artificial graphite; such conductive metal oxide as tin oxide, titanium oxide, zinc oxide or the like; metal such as nickel, copper, silver, germanium or the like. These conductive agents may be used either alone or in combination with each other.

The amount of the conductive agent to be added is not limited in particular, though in the case of ion conductive agent, it is added to be within an ordinary range of 0.01 to 5 in weight part, preferably 0.05 to 2 in weight part, with reference to the foamed elastic member of 100 in weight part. In the case of an electronic conductive agent, it is added to be within an ordinary range of 1 to 50 in weight part, preferably 5 to 40 in weight part, with reference to the foamed elastic member of 100 in weight part. The conductive foamed elastic layer may be added, if necessary, with other additives for rubber, such as known bulking agent or bridging agent, besides the above-mentioned conductive agent.

According to the present invention, when the foamed elastic member for the toner feed roller is made of polyurethane foam, it is preferred that the acetone extraction ratio of polyurethane foam is 5 weight % or less, such that deposition on the surface of the roller does not have toner molten and adhered. It is thus necessary to sufficiently examine the amount of a conductive agent to be added. In this connection, when a large amount of carbon black having a high volatility (e.g., channel black) is added, the acetone extraction ratio can be increased. On the other hand, when carbon black having high oil absorptivity (e.g., acetylene black or oil furnace black of high structure) is added, the acetone extraction ratio can be reduced.

The developing roller to be used in a developing device according to the present invention is conductive, per se, and may be a roller having a conductive elastic layer formed outside a good-conductivity shaft in a similar manner to a conventional conductive developing roller, or may be what is called a developing sleeve using a good-conductivity shaft as it is. An elastic material afforded with conductivity by adding a conductive agent as described above to a suitable rubber-like elastic member is used for a developing roller having such a conductive elastic layer formed thereon. In this case, there is no particular limitation in the rubber-like elastic member, and it is possible to use a rubber-like elastic member optionally selected from ordinarily used conventional conductive developing rollers. The rubber-like elastic material may be comprised, for example, of nitrite rubber, ethylene propylene rubber, ethylene propylene diene rubber, styrene butadiene rubber, butadiene rubber, isoprene rubber, natural rubber, silicone rubber, urethane rubber, acrylic rubber, chloroprene rubber, butyl rubber, epichlorohydrin rubber or the like, and particularly nitrite rubber, urethane rubber, epichlorohydrin rubber, ethylene propylene rubber, ethylene propylene diene rubber, and silicone rubber are preferable. They may be used either alone or in combination with each other.

When a developing roller has a conductive elastic layer formed thereon, in order to prevent contamination or the like of a photosensitive, member, it is preferred to provide the surface of the roller with a resin coating of 1 to 100 $\mu$m in thickness, composed, for example, of such bridge forming resin as alkyd resin, phenol resin, melamine resin, mixture thereof or the like. These bridge forming resins may contain various additives such as electric charge control agent, sliding agent, conductive agent or other resins, if desired. The resin coating layer can be formed ordinarily by applying a coating solution made by dissolving or dispersing a bridge forming resin, bridging agent and various additives in a solvent (such as an alcohol-based solvent such as methanol, a ketone-based solvent such as methyl ethyl ketone, or the like) to an elastic layer by means of a dipping method, a roll coater method, a doctor blade method, a spraying method or the like, and bridge-hardening it through drying at the normal temperature or at a temperature of about 50 to 170° C.

The present invention will be more concretely described below with reference to the following embodiments. However, the invention is not limited to these embodiments, so long as the purport of the invention is retained. With respect to the following embodiments and comparative examples, the physical properties of a toner feed roller were measured in the following manner.

Average Cell Opening, Diameter

The average cell opening diameter was obtained by taking photographs of the surface of a toner feed roller at a magnification of 40 to 60 by means of a CCD video camera made by Hirocks, Inc., and measuring and averaging the diameters of cell openings of the photographic images.

Cell Opening Ratio

The cell opening ratio was obtained by taking photographs of the surface of a toner feed roller at a magnification of 40 to 60 by means of the same CCD video camera made by Hirocks, Inc., computing the area of cell openings of the photographic image and dividing it by the area of the whole photographic image.

Compression Spring Constant

Figure 4:
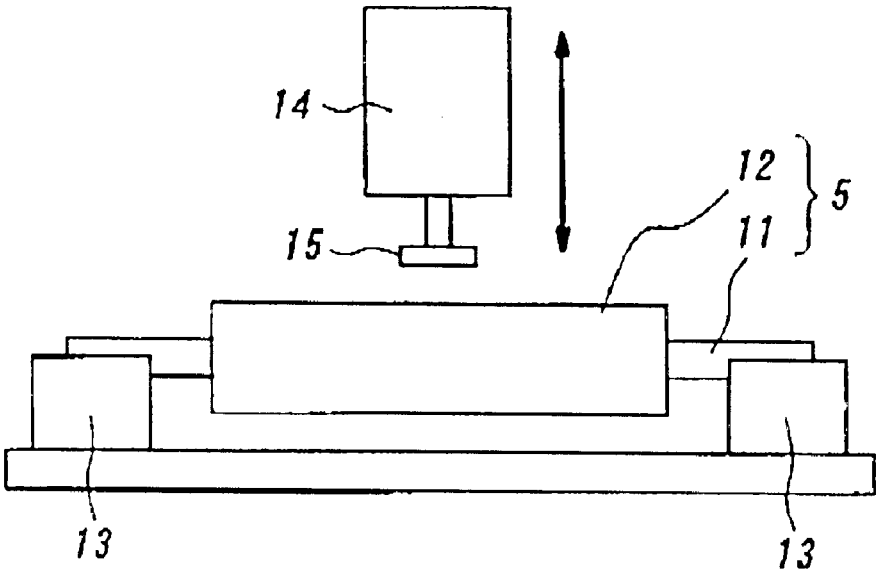
FIG. 4 is an explanatory view showing the method of measuring the compression spring constant and the restoring ratio of elasticity after compression of a foamed elastic member in a toner feed roller.

The compression spring constant of a toner feed roller was measured in the circumferential direction and the longitudinal direction of the roller by means of a measuring method shown in FIG. 4. That is to say, this method is to horizontally fix the rotation shaft 11 of a toner feed roller 5 by means of V-blocks 13, to move a force gauge 14 set above a foamed elastic roller 12 downward at a constant speed (0.1 mm/sec), to compress it to a depth of about 1.0 mm by means of a disk-shaped compression jig (disk compressor) 15 of 13 mm in diameter provided at the tip end of the force gauge 14, and to compute the spring constant of the roller on the basis of a stress-strain curve obtained by the measurement. The compression spring constant was determined by 4-point-measuring compression spring constants at intervals of 30 mm in the longitudinal direction of the roller and at intervals of 90 degrees in the circumferential direction of the roller, and averaging the measured compression spring constants.

Restoring Ratio of Elasticity After Compression

The restoring ratio of elasticity after compression was determined by 4-point-measuring of the restoring ratios of elasticity after compression of a toner feed roller at intervals of 90 degrees in the circumferential direction in the middle part of the roller by a method similar to the compression spring constant measuring method shown in FIG. 4, and averaging the measured restoring ratios of elasticity after compression. That is to say, this method is to horizontally fix the rotation shaft 11 of a toner feed roller 5 by means of V-blocks 13, to move a force gauge 14 set above a foamed elastic roller 12 downward at a constant speed (0.1 mm/sec), to compress it to a depth of about 1.0 mm by means of a disk-shaped compression jig (disk compressor) 15 of 13 mm in diameter provided at the tip end of the force gauge 14, to release the roller from compression by lifting the disk compressor at the same speed as the compression speed, and to compute the ratio ($S_B/S_A$) of the area ($S_A$) in the compression process of a stress-strain curve measured in the compression-releasing process and the area ($S_B$) in the releasing process thereof, as the restoring ratio of elasticity after compression.

Coefficient of Friction

Figure 5:
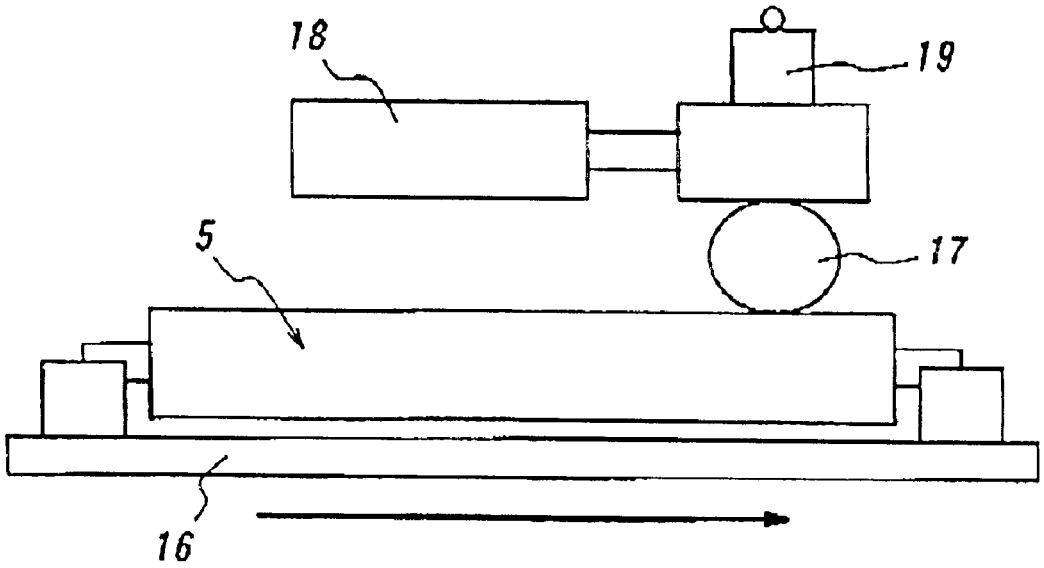
FIG. 5 is an explanatory view showing the method of measuring the coefficient of friction of the surface of a foamed elastic member in a toner feed roller.

The coefficient of friction of a toner feed roller was measured by a measuring method shown in FIG. 5, using a friction tester "HEIDON TRIBOGIA" made by Shinto Kagaku, Inc. That is to say, this method is to fix a toner feed roller 5 on a movable stage 16 and move it at a friction speed of 100 mm/min. An opposite party of friction in the form of a round bar 17 made of acrylic resin of 12 mm in diameter, which is arranged perpendicularly to the toner feed roller, was rubbed against the toner feed roller under a load of 0.1 N. A frictional force at this time was measured by a load cell 18, and the coefficient of friction was determined as a value obtained by dividing the measured value by the load. The reason for selecting an acrylic material as the opposite party of fiction is that the primary component of toner is similar to acrylic resin and the friction by the combination in the examples simulates the friction between a toner feed roller and toner. In this instance, the coefficient of friction was measured three times for one roller and the average of the measured values was used.

Reference (Preparation of Developing Roller A)

Polyether polyol (OH value: 33 mg KOH/g) of 100 in weight part, having a molecular weight of 5000, and obtained by adding propylene oxide and ethylene oxide to glycerol, is added with 1,4-butanediol of 1.0 in weight part, nickel acetylacetate of 0.5 in weight part, dibutyl tin dilaurate of 0.01 in weight part and sodium perchlorate of 0.2 in weight part, and they were mixed by a mixing machine to prepare polyol compositoin. This polyol composition was stirred under a reduced pressure to be defoamed, and then added with urethane denatured MDI (diphenylmethane diisocyanate) of 175 in weight part, and stirred for 2 minutes. The polyol composition was then injected into a metal mold having a shaft placed in it and being heated in advance to 110° C., and was cured at 110° C. for 2 hours to thereby obtain a roller having a conductive elastic layer on the outer circumferential surface of the metal shaft. The surface of the obtained roller was ground so as to be 4.0 $\mu$mRz in 10-point average roughness according to Japan Industrial Standards (JIS). Next, using an oil-free alkyd resin (M6402 made by Dainippon Ink and Chemicals, Inc.) and a melamine resin (SUPER BECKAMINE, L-145-60 having a solid content of 60 weight % made by Dainippon Ink and Chemicals, Inc.) as a resin for forming a resin coating layer, the oil-free alkyd resin and the melamine resin were mixed with a solvent of methyl ethyl ketone so as to be 80/20 in solid weight ratio and the mixed solution was made so as to be 20 weight % in solid concentration. Carbon (Printex L6 of 18 nm in average particle diameter made by Degussa, Inc.) of 20 in weight part (20 phr) was mixed in this mixture having a solid part of 100 in weight part, and was dispersed by means of a paint shaker to thereby make a coating solution. The above-mentioned roller was dipped in and pulled up from this coating solution, and was heated at 130° C. for 3 hours to thereby form a developing roller A having a hardened resin coating layer.

Embodiments 1, 2 and Comparative Examples 1 to 9

The developing roller A made as reference was assembled into the printer shown in FIG. 1 in combination with a toner feed roller B, C, D, E, F, G, H, I, J, K or L described below, and images were formed in an environment of constant temperature and constant humidity (25° C., 50% RH), to evaluate the image quality.

First, the toner feed rollers B to L were made by a method as follows.

Polyether polyol of 100 in weight part, having an average molecular weight of 5000 and three functional groups and having 80% of end hydroxide groups of it as first-class hydroxide groups, said polyether polyol being obtained by adding propylene oxide of 12 weight % and ethylene oxide of 88 weight % to glycerol and polymerizing them, water of 2.0 in weight part, diethanol amine of 1,00 in weight part as a bridging agent, a DPC (dipropylene glycol) solution of 0.60 in weight part, of triethylene diamine of 33 weight % as a catalyst, N, N, N', N'-tetra-methyl hexanediamine of 0.30 in weight part, and polyether denatured silicone oil (SF2965 made by Toray-Dow Corning Silicone, Inc.) of 2.00 in weight part were stirred and mixed together in advance, and this mixed material was defined as component A. On the other hand, blended polyisocyanate (CORONATE 1021 made by Nippon Polyurethane Industry Co., Ltd.) composed of TDI-80 of 80 weight % and MDI of 20 weight % as polyisocyanate was defined as component B. Components A and B were respectively put into tanks of a small foaming machine. The discharging flow rates of components A and B per unit time were adjusted within such a range that component A/component B=110.90/29.20 to 105.70/26.77 in weight ratio. The two components were stirred and mixed at about 3000 rpm in rotation speed of an impeller. This mixture was injected into a cylinder-shaped mold, in which a metal shaft is arranged in the center thereof. The mold is 16.0 mm in inner diameter and 22 cm in length, and has its inner surface coated with fluoro-resin. The injection was performed by changing the amount of the injected mixture according to the hardness of polyurethane foam to be obtained through a nozzle from an opening provided at the end portion of the mold. The end portion of the mold was covered with a cap before the injected polyurethane was foamed and leaked out from the end portion. The injected polyurethane was cured by heating for 10 minutes in an oven of a hot air circulation type of 70° C. A roller having a polyurethane layer formed on the outer circumference of the shaft was taken out from the mold, and was further cured by heating for 15 minutes in an oven of a hot air circulation type of 120° C., to complete preparation of toner feed rollers B, C, D, E, F, G, H, I, J, K and L made of polyurethane foam. Toner feed rollers G and H were changed in friction coefficient by applying viscous wax or silicone oil to rollers made in the same way as toner feed roller C. Further, toner feed roller L was made larger in cell opening ratio by grinding the surface of a roller made in the same way as toner feed roller K by about 0.3 mm.

Physical property tests were performed on the toner feed rollers obtained in this manner, in the manner described above. That is to say, measurement of the average cell opening diameter and cell opening ratio was performed by taking photographs, measurement of the compression spring constant and the restoring ratio of elasticity after compression was performed by the method shown in FIG. 4, and measurement of the coefficient of friction was performed by the method shown in FIG. 5. Then, each of the toner feed rollers B to L was arranged as a toner feed roller 5 of the printer shown in FIG. 1 and the developing roller A was arranged as a developing roller 6, to perform an image evaluation test. The image evaluation test was performed in the longitudinal feed direction of a sheet paper of A4 size, under constant temperature and constant humidity environment (25° C., 50% RH). Table 1 shows the result of the physical property tests and the image evaluation tests of toner feed rollers. In order to evaluate an image, a dark gray solid image was formed. The result wherein the formed image was uniform and good in image quality is represented as "o", and the result wherein the formed image was uneven in image quality due to irregular density or the like is represented as "x".

TABLE 1

| | Toner feed roller | Average cell opening diameter (μm) | Cell opening ratio (%) | Coefficient of friction | Compression spring constant (N/mm) | Restoring ratio of elasticity after compression (%) | Image quality |
|---|---|---|---|---|---|---|---|
| Embodiment 1 | B | 205 | 63 | 1.8 | 0.6 | 88 | ○ |
| Embodiment 2 | C | 260 | 65 | 2.0 | 0.5 | 75 | ○ |
| Comparative Example 1 | D | 286 | 70 | 1.8 | 0.6 | 45 | x |
| Comparative Example 2 | E | 282 | 53 | 1.2 | 0.2 | 62 | x |
| Comparative Example 3 | F | 153 | 55 | 1.7 | 2.4 | 65 | x |
| Comparative Example 4 | G | 265 | 63 | 3.2 | 0.5 | 75 | x |
| Comparative Example 5 | H | 255 | 65 | 0.2 | 0.5 | 75 | x |
| Comparative Example 6 | I | 330 | 60 | 1.7 | 0.6 | 70 | x |
| Comparative Example 7 | J | 30 | 51 | 1.7 | 0.6 | 73 | x |
| Comparative Example 8 | K | 100 | 30 | 1.5 | 0.8 | 78 | x |
| Comparative Example 9 | L | 297 | 89 | 1.5 | 0.7 | 75 | x |

The results of Table 1 reveal the following:

(1) An image free from such defect as irregularity in density or the like can be obtained only when any of the average opening diameter (average cell opening diameter) and the cell opening ratio of foam cells opened on the surface of the foamed elastic member of a toner feed roller, and the compression spring constant, the restoring ratio of elasticity after compression and the coefficient of friction of the foamed elastic member of the toner feed roller is in the proper range according to the present invention.

(2) An image defect such as irregularity in density or the like occurs to a greater or lesser extent, when some of the average opening diameter (average cell opening diameter), the cell opening ratio, the compression spring constant, the restoring ratio of elasticity after compression and the coefficient of friction of a toner feed roller is out of the proper range according to the present invention.

According to the embodiments of the present invention described above, by keeping any of the average cell opening diameter, the cell opening ratio, the compression spring constant, the restoring ratio of elasticity after compression and the coefficient of friction in the foamed elastic member of a toner feed roller in a proper range, the toner is advantageously pressed against a developing roller by a toner feed roller, the feeding of the toner to the developing roller and electrically charging toner are advantageously performed, and the toner remaining on the developing roller is advantageously scraped away, thereby making it possible to form a good image free from such defect as irregularity in pitch or density.

A foamed elastic member, which is capable of providing a good image fir from such defects as irregularity in pitch or density and also from reduction in density, and which can be suitably used in electrophotographic apparatuses, particularly advantageously as toner feed rollers, can be realized also by properly determining the shape of openings on the surface of a polyurethane foam member molded by an in-mold foaming process, and nuttier by regularly arranging these openings.

That is to say, a foamed elastic member according to the above-mentioned aspect of the present invention is made of polyurethane foam molded by an in-mold foaming process, and has a plurality of openings each having a shape approximate to a circle, ellipse, racetrack (the shape of a track in an athletic field, wherein two circles are tied by two straight lines tangent to both circles), triangle, tetragon or hexagon regularly arranged on the surface of it. The regular arrangement may be such that the center point of each of the plural openings is positioned at a vertex of a square, rectangle, regular triangle or isosceles triangle.

Figure 6A:
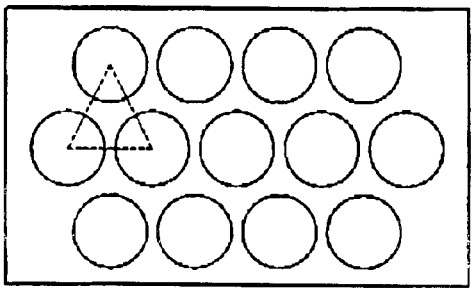
FIGS. 6A to 6J are schematic views showing various examples, in the opening shape and arrangement, of the toner feed roller according to the present invention.
Figure 6B:
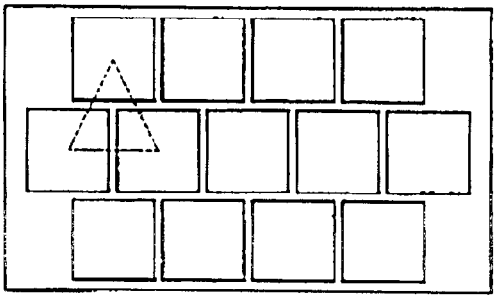
Figure 6C:
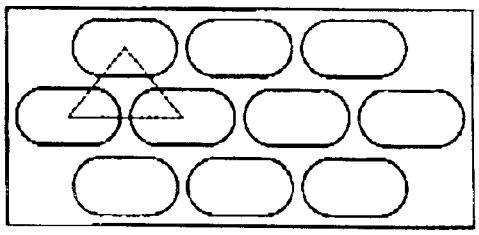
Figure 6D:
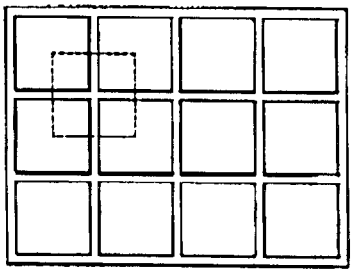
Figure 6E:
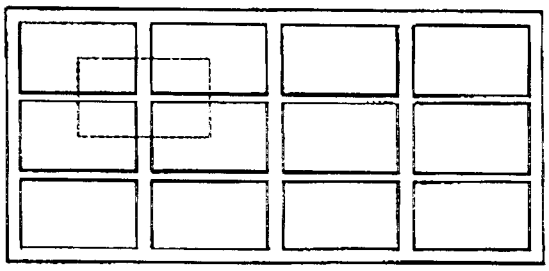
Figure 6F:
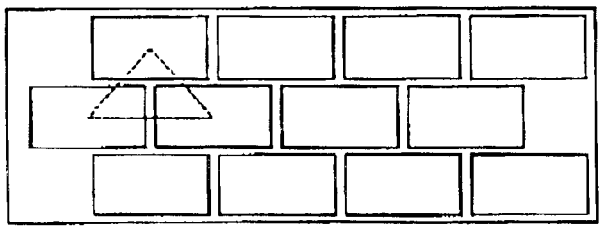
Figure 6G:
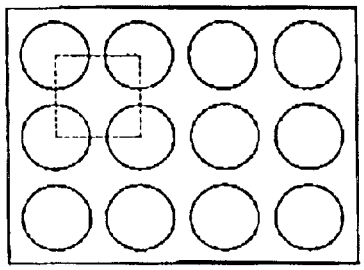
Figure 6H:
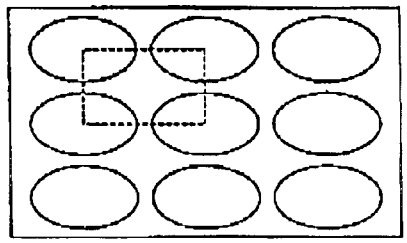
Figure 6I:
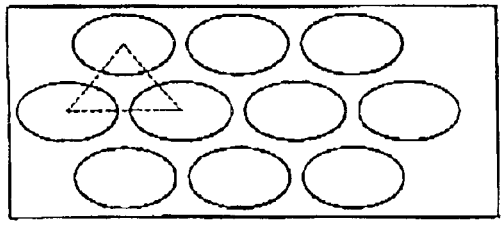
Figure 6J:
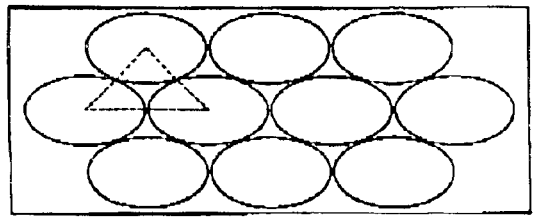

FIGS. 6A to 6J are plan views showing examples of the shape and arrangement of the openings. First, the example shown in FIG. 6A provides a plurality of circular openings that are arranged so that the center point of each opening is positioned at a vertex of a regular triangle. The example shown in FIG. 6B provides a plurality of square openings that are arranged so that the center point of each opening is positioned at a vertex of a regular triangle. The example shown in FIG. 6C provides a plurality of racetrack-shaped openings that are arranged so that the center point of each opening is positioned at a vertex of an isosceles triangle. The example shown in FIG. 6D provides a plurality of square openings that are arranged so that the center point of each opening is positioned at a vertex of a square. The example shown in FIG. 6E provides a plurality of rectangular openings that are arranged so that the center point of each opening is positioned at a vertex of a rectangle. The example shown in FIG. 6F provides a plurality of rectangular openings that are arranged so that the center point of each opening is positioned at a vertex of an isosceles triangle. The example shown in FIG. 6G provides a plurality of circular openings that are arranged so that the center point of each opening is positioned at a vertex of a square. The example shown in FIG. 6H provides a plurality of elliptic openings that are arranged so that the center point of each opening is positioned at a vertex of a rectangle. The example shown in FIG. 6I provides a plurality of elliptic openings that are arranged so that the center point of each opening is positioned at a vertex of an isosceles triangle. Finally, the example shown in FIG. 6J provides a plurality of elliptic openings that are arranged so that the center point of each opening is positioned at a vertex of an isosceles triangle.

It is preferred that the average equivalent circle diameters of the openings is 50 to 500 $\mu$m in, the average distance between the centers of two openings adjacent to each other is 50 to 600 $\mu$m, and the ratio (opening ratio) of the total area of openings to the whole surface area is 50 to 100%. The equivalent circle diameter of the openings refers to a diameter of a circle having the same area as the opening, and the average value thereof refers to an average value of the equivalent circle diameters of a plurality of openings. The average distance between the centers of two openings adjacent to each other refers to the average of the two or more distances each between two openings adjacent to each other, said distances being different from one another. Thus, for example, when the openings are arranged so that the center point of each opening is positioned at a vertex of a rectangle, the average distance refers to the average in length of long sides and short sides of the rectangle. Also, when the openings are arranged so that the center point of each opening is positioned at a vertex of an isosceles triangle, the average distance refers to the average in length of two sides being different in length from each other of the isosceles triangle.

When the average value of equivalent circle diameters is less than 50 $\mu$m, there is a possibility that image defect occurs due to loading or insufficient supply of toner. On the other hand, when the average value of them exceeds 500 $\mu$m, there is a possibility that image defect occurs due to irregular supply of toner to a developing roller. When the average distance between the centers of two openings adjacent to each other is less than 50 $\mu$m, there is a possibility that image defect occurs due to clogging or insufficient supply of toner. On the other hand, when the average distance exceeds 600 $\mu$m, there is a possibility that image defect occurs due to irregular supply of toner to a developing roller. When the ratio of the total area of openings to the whole surface area is less than 50%, there is a possibility that image defect occurs due to irregular supply of toner to a developing roller.

It is preferred that the urethane foam at the surface of a roller having these openings thereon is 0.25 to 1.5 N/mm in compression spring constant. When the compression spring constant is less than 0.25 N/mm, there is a possibility that the density of the image is made deficient or irregular due to insufficiency in scraping and supply of toner. On the other hand, when the compression spring constant exceeds 1.5 N/mm, there is a possibility that, even if an image at an initial stage is good, the durability is insufficient so that image defect occurs.

A urethane foam member having such openings on its surface can be molded by means of an in-mold foaming process by using a cylinder-shaped mold having dents that are shaped corresponding to the openings on its inner surface. In this case, the openings similar in shape to the dents on the inner surface of the cylinder-shaped mold are formed at positions corresponding to the dents. Therefore, by properly adjusting the shape and arrangement of the dents on the inner surface of the mold, it is possible to control the shape and arrangement of openings at the surface of the urethane foam member. A foamed elastic member according to the present invention is formed by foaming in a mold having minute dents on the inner surface thereof, each being of the shape of circle, ellipse, racetrack, triangle, tetragon or hexagon. It is preferred that these dents are arranged regularly so that the center point of each opening is positioned at a vertex of a square, rectangle, regular triangle or isosceles triangle. It is further preferred that the average value of the equivalent circle diameters of the dents is 50 to 500 $\mu$m, the average distance between the centers of two dents adjacent to each other is 50 to 600 $\mu$m, the depth of the dents is 5 to 500 $\mu$m in depth, and the ratio of the total area of the dents to the whole area of the inner surface of the mold is 50 to 95%.

Such a cylinder-shaped mold is subjected to minute dent/projection process on its inner surface in advance, by means of etching process, machining process, laser beam machining process, ultraviolet-setting resin forming process, electroforming process or the like, so as to form the dents as described above. It is preferred that the mold is used after coating its surface in advance with a coating material having a large contact angle such as a fluoro-resin, silicone resin or the like, or applying in advance a skinless mold lubricant to the surface of the mold.

A urethane foam elastic member according to the present invention is obtained by stirring and mixing polyol, polyisocyanate, foaming agent, catalyst, foam adjusting agent and, if necessary, other compounding agent, additives or the like, and then injecting the mixture thereof into a cylinder-shaped mold as described above, and foam-molding it. It is preferred to use a polyol having 2 to 4 functional groups, molecular weight of 2000 to 10000, and end functional groups of 50 to 100 in OH %, with ethylene oxide added by an a mount of 2 to 25%. Such polyol may be used in blend with another kind of polyol. It is preferred to use a polyisocyanate having an isocyanate component comprised of tolylene diisocyanate (TDI), diphenylmethane diisocyanate (MDI); crude diphenylmethane diisocyanate (crude MDI); isophorone diisocyanate; kinds of polyisocyanate or their isocyanurate having no unsaturated bond such as hydrogen added diphenylmethane diisocyanate, hydrogen added tolylene diisocyanate, hexamethylene diisocyanate or the like; carbodiimide; denatured glycol, or the like. It is particularly preferred to use TDI-80 that is a mixture of 2,4-toluene diisocyanate and 2,6-toluene diisocyanate of 80/20 in mixture ratio, or blended isocyanate (Coronate 1021 made by Nippon Polyurethane Industry, Co., Ltd. for example) of TDI-80 and crude diphenylmethane diisocyanate (crude MDI) of 80/20 in blend ratio. A low-hardness and minute-cell foam material can be obtained also by reacting polyisocyanate with polyol by means of a one-shot method, or also by reacting polyisocyanate with polyol in advance to make urethane prepolymer and then reacting it with formic acid, water, chain-extending agent or the like.

The elastic member may be either a non-conductive member or a conductive member. In case of a non-conductive member, a conductive agent need not be added. In case of a conductive member, it is preferred to use a carbon conductive agent and an ion conductive agent. The carbon black may be comprised, for example, of electrified black, ketene black, gas black such as acetylene black or the like, oil furnace black including ink black, thermal black, channel black, lamp black or the like. Water-dispersed carbon is also preferably used in order to avoid insufficiency in stirring and mixing, which may be caused by an increased viscosity of the carbon material. The ion conductive agents is preferably comprised, for example, of inorganic salt such as lithium perchlorate, sodium perchlorate and calcium perchlorate, and fourth-class ammonium salt such as lauryl trimethyl ammonium chloride, stearyl trimethyl ammonium chloride, octadecyl trimethyl ammonium chloride, dodecyl trimethyl ammonium chloride, hexadecyl trimethyl ammonium chloride, denatured aliphatic dimethylethylammonium ethosulfate, tetraethyl ammonium perchlorate, tetrabutyl ammonium perchlorate, tetrabutyl ammonium fluoroboride, tetraethyl ammonium fluoroboride, tetrabutyl ammonium chloride. Metal oxide powder, metal powder or the like may also be used as a conductive agent.

The conductive elastic member according to the present invention can be utilized in various applications and, more particularly, can be preferably used as a toner feed member of an image forming apparatus. With reference to the following embodiments and comparative examples, the present invention is concretely described, but the present invention is not limited to the following embodiments. (For the sake of convenience, embodiments 3 to 10 and comparative example 10 are skipped.)

Embodiment 11

Polyether polyol of 100 in weight part, having a molecular weight of 5000 and three functional groups and having end hydroxide groups of 80% in first-class hydroxide group content, said polyether polyol being obtained by adding propylene oxide of 13 weight % and ethylene oxide of 87 weight % to glycerol, as well as water of 1.8 in weight part, diethanol amine of 1.00 in weight part, a 33%-triethylene diamine DPG (dipropylene glycol) solution of 0.65 in weight part, N, N, N', N'-tetramethyl hexanediamine of 0.28 in weight part, and ether denatured silicone oil (SF2965 made by Toray-Dow Corning Silicone, Inc.) of 2.00 in weight part were stirred and nixed together in advance. This mixture is defined as component A. On the other hand, polyisocyanate comprising a blended polyisocyanate (CORONATE 1021 made by Nippon Polyurethane Industry, Co., ltd.) composed of TDI-80 of 80 weight % and MDI of 20 weight % is defined as component B. There was prepared a cylinder-shaped mold of 16.0 mm in inner diameter and 22 cm in length, having circular dents each being 220 $\mu$m in diameter and 50 $\mu$m in depth, which are provided on the inner surface of the mold at a center distance of 250 $\mu$m so that the center point of each dent is positioned at a vertex of a regular triangle as shown in FIG. 6A. Components A and B were respectively put into tanks of a small foaming machine. The discharging flow rates of components A and B were adjusted so that the weight ratio of components A and B to be discharged per unit time is component A/component B=105.70/26.77. Components A and B were stirred and mixed at about 3000 rpm in rotation speed of an impeller. The resulting mixture was injected into a mold having a core shaft arranged in the center of it through a discharging nozzle, and the end portion of the pipe was covered with a cap before the injected polyurethane material was foamed and leaked out from that end portion. The injected mixture was cured by heating for 10 minutes in a hot air circulation type oven at 70° C. A roller composed of the core shaft and urethane foam was then taken out from the pipe, and was further cured by heating for 15 minutes in a hot air circulation type oven at 120° C., so as to complete a roller made of non-conductive urethane foam. Circular openings were regularly arranged on the surface of the urethane foam roller so obtained, corresponding to the dents on the inner surface of the mold. The compression spring constant of the roller was 0.46 N/mm, the average cell diameter of openings on the surface of the roller was 210 $\mu$m, and the area ratio (opening ratio) of the openings on the surface of the roller was 63%. This roller was assembled into a dry type electrophotographic apparatus as a toner feed roller, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.032. From the result of measurement, it was found that this embodiment was less in irregularity of the image in comparison with the case where the shape and arrangement of the cells were not controlled (comparative example 11).

Embodiment 12

A non-conductive urethane foam roller was made by the same method as embodiment 11, except that circular dents each being 220 $\mu$m in diameter and 100 $\mu$m in depth were arranged at a center distance of 250 $\mu$m so that the center point of each of the dents was positioned at a vertex of a regular triangle on the inner surface of the mold as shown in FIG. 6A. Circular openings were regularly arranged on the surface of the urethane foam roller so obtained, corresponding to the dents on the inner surface of the mold. The compression spring constant of the roller was 0.43 N/mm, the average cell diameter of openings on the surface of the roller was 200 $\mu$m, and the area ratio (opening ratio) of the openings on the surface of the roller was 65%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of the Macbeth densitometer. The difference between the maximum density and the minimum density at 9 measured points was 0.028. From the result of measurement, it was found that this embodiment was less in irregularity of the image in comparison with the case where the shape and arrangement of the cells were not controlled (comparative example 11).

Embodiment 13

A non-conductive urethane foam roller was made by the same method as embodiment 11, except that square dents each being 156 μm in side length and 50 μm in depth were arranged at a center distance of 250 μm so that the center point of each of the dents was positioned at a vertex of a regular triangle on the inner surface of the mold as shown in FIG. 6B. Square openings were regularly arranged on the surface of the urethane foam roller so obtained, corresponding to the dents on the inner surface of the mold. The compression spring constant of the roller was 0.42 N/mm, the average cell diameter (length of one side) of openings on the surface of the roller was 150 μm, and the area ratio (opening ratio) of the openings on the surface of the roller was 64%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.039. From the result of measurement, it was found that this embodiment was less in irregularity of the image in comparison with the case where the shape and arrangement of the cells were not controlled (comparative example 11).

Embodiment 14

A non-conductive urethane foam roller was made by the same method as embodiment 11, except that racetrack-shaped dents each being 450 μm in major axis length, 220 μm in minor axis length and 50 μm in depth were arranged at a center distance of 550 μm so that the center point of each of the dents was positioned at a vertex of an isosceles triangle (having two sides of 430 μm in length and one side of 550 μm) on the inner surface of the mold as shown in FIG. 6C. Substantially racetrack-shaped openings were regularly arranged on the surface of the urethane foam roller so obtained, corresponding to the dents on the inner surface of the mold. The compression spring constant of the roller was 0.41 N/mm, the average cell diameter of openings on the surface of the roller was 450 μm in major axis and 220 μm in minor axis, and the area ratio (opening ratio) of the openings on the surface of the roller was 63%. This roller was assembled into a dry type electrophotographic apparatus as a toner feed roller, in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.033. From the result of measurement, it was found that this embodiment was less in irregularity of the image in comparison with the case where the shape and arrangement of the cells were not controlled (comparative example 11).

Embodiment 15

A non-conductive urethane foam roller was made by the same method as embodiment 11, except that racetrack-shaped dents each being 450 μm in major axis length, 220 μm in minor axis length and 100 μm in depth were arranged at a center distance of 550 μm so that the center point of each of the dents was positioned at a vertex of an isosceles triangle (having two sides of 430 μm in length and one side of 550 μm) on the inner surface of the mold as shown in FIG. 6C. Substantially racetrack-shaped openings were regularly arranged on the surface of the urethane foam roller so obtained, corresponding to the dents on the inner surface of the mold. The compression spring constant of the roller was 0.43 N/mm, the average cell diameter of openings on the surface of the roller was 440 μm in major axis and 215 μm in minor axis, and the area ratio (opening ratio) of the openings on the surface of the roller was 62%. This roller was assembled into a dry type electrophotographic apparatus as a toner feed roller, in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.037. From the result of measurement, it was found that this embodiment was less in irregularity of the image in comparison with the case where the shape and arrangement of the cells were not controlled (comparative example 11).

Embodiment 16

A non-conductive urethane foam roller was made by the same method as embodiment 11, except that elliptic dents each being 450 μm in major axis length, 220 μm in minor axis length and 100 μm in depth were arranged at a center distance of 550 μm so that the center point of each of the dents was positioned at a vertex of an isosceles triangle (having two sides of 430 μm in length and one side of 550 μm) on the inner surface of the mold as shown in FIG. 6I. Substantially elliptic openings were regularly arranged on the surface of the urethane foam roller so obtained, corresponding to the dents on the inner surface of the mold. The compression spring constant of the roller was 0.42 N/mm, the average cell diameter of openings on the surface of the roller was 440 μm in major axis and 210 μm in minor axis, and the area ratio (opening ratio) of the openings on the surface of the roller was 64%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.037. From the result of measurement, it was found that this embodiment was less in irregularity of the image in comparison with the case where the shape and arrangement of the cells were not controlled (comparative example 11).

Embodiment 17

A non-conductive urethane foam roller was made by the same method as embodiment 11, except that regular triangle-shaped dents each being 330 μm in side length and 100 μm in depth were arranged at a center distance of 220 μm so that dents adjacent to each other were placed in vertically inverse relation to each other and the center point of each of the dents was positioned at a vertex of a regular triangle (having a side of 220 μm in length) on the inner surface of the mold as shown in FIG. 6G (although being different in shape), Substantially regular triangle-shaped openings were regularly arranged on the surface of the urethane foam roller so obtained, corresponding to the dents on the inner surface of the mold. The compression spring constant of the roller was 0.41 N/mm, the average cell size of openings on the surface of the roller was a regular triangle of 295 μm in side length, and the area ratio (opening ratio) of the openings on the surface of the roller was 80%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.037. From the result of measurement, it was found that this embodiment was less in irregularity of the image in comparison with the case where the shape and arrangement of the cells were not controlled (comparative example 11).

Embodiment 18

A non-conductive urethane foam roller was made by the same method as embodiment 11, except that regular hexagon-shaped dents each being 220 μm in side length and 100 μm in depth were made on the inner surface of the mold. Substantially regular hexagon-shaped openings were regularly arranged on the surface of the urethane foam roller so obtained, corresponding to the dents on the inner surface of the mold. The compression spring constant of the roller was 0.43 N/mm, the average cell size of openings on the surface of the roller was a regular hexagon of 210 μm in side length, and the area ratio (opening ratio) of the openings on the surface of the roller was 52%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.037. From the result of measurement, it was found that this embodiment was less in irregularity of the image in comparison with the case where the shape and arrangement of the cells were not controlled (comparative example 11).

Comparative Example 11

A non-conductive urethane foam roller was made by the same method as embodiment 11, except that a pipe-shaped mold having a smooth surface not subjected to minute dent/projection process on its inner surface was used. Openings on the surface of the urethane foam roller so obtained were uneven in shape and irregular in arrangement also. The compression spring constant of the roller was 0.43 N/mm, the average cell diameter of openings on the surface of the roller was 210 μm, and the area ratio (opening ratio) of the openings on the surface of the roller was 61%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.057. From the result of measurement, it was found that this comparative example was more in irregularity of the image in comparison with the case where the shape and arrangement of the cells were controlled (embodiment 11).

Comparative Example 12

A non-conductive urethane foam roller was made by the same method as embodiment 11, except that circular dents each being 220 μm in diameter and 5 μm in depth were arranged at a center distance of 250 μm so that the center point of each dent is positioned at a vertex of a regular triangle on the inner surface of the mold as shown in FIG. 6A. Openings on the surface of the urethane foam roller so obtained did not correspond in shape to the dents on the inner surface of the mold and were uneven in shape and irregular in arrangement also. The compression spring constant of the roller was 0.42 N/mm, the average cell diameter of openings on the surface of the roller was 220 μm, and the area ratio (opening ratio) of the openings on the surface of the roller was 60%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.053. From the result of measurement, it was found that this comparative example was more in irregularity of the image in comparison with the case where the shape and arrangement of the cells were controlled (embodiment 11).

Comparative Example 13

A non-conductive urethane foam roller was made by the same method as embodiment 11, except that square dents each being 570 μm in side length and 50 μm in depth were arranged at a center distance of 900 μm so that the center point of each dent is positioned at a vertex of a regular triangle on the inner surface of the mold as shown in FIG. 6B. Openings on the surface of the urethane foam roller so obtained did not correspond in shape to the dents on the inner surface of the mold and were uneven in shape and irregular in arrangement also. The compression spring constant of the roller was 0.44 N/mm, the average cell diameter of openings on the surface of the roller was 180 μm, and the area ratio (opening ratio) of the openings on the surface of the roller was 59%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.051. From the result of measurement, it was found that this comparative example was more in irregularity of the image in comparison with the case where the shape and arrangement of the cells were controlled (embodiment 11).

Comparative Example 14

A non-conductive urethane foam roller was made by the same method as embodiment 11, except that square dents each being 570 μm in side length and 50 μm in depth were arranged at a center distance of 900 μm so that the center point of each dent is positioned at a vertex of a regular triangle on the inner surface of the mold as shown in FIG. 6B. Openings on the surface of the urethane foam roller so obtained did not correspond in shape to the dents on the inner surface of the mold and were uneven in shape and irregular in arrangement also. The compression spring constant of the roller was 0.43 N/nm, the average cell diameter of openings on the surface of the roller was 460 μm, and the area ratio (opening ratio) of the openings on the surface of the roller was 63%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.055. From the result of measurement, it was found that this comparative example was more in irregularity of the image in comparison with the case where the shape and arrangement of the cells were controlled (embodiment 11).

Comparative Example 15

A non-conductive urethane foam roller was made by the same method as embodiment 11, except that racetrack-shaped dents each being 450 μm in major axis length, 220 μm in minor axis length and 100 μm in depth were arranged at a center distance of 550 μm so that the center point of each dent is positioned at a vertex of an isosceles triangle (having two sides of 430 μm and one side of 550 μm) on the inner surface of the mold as shown in FIG. 6C. Openings on the surface of the urethane foam roller so obtained did not correspond in shape to the dents on the inner surface of the mold and were uneven in shape and irregular in arrangement also. The compression spring constant of the roller was 0.41 N/mm, the average cell diameter of openings on the surface of the roller was 230 μm, and the area ratio (opening ratio) of the openings on the surface of the roller was 61%. This roller was assembled into a dry type electrophotographic apparatus as a toner feed roller in the same way as embodiment 11, and was then left as it was at a temperature of 20° C. and a humidity of 50% RH for 48 hours. Subsequently, a blue solid image was printed successively on 10 sheets of A4 size paper, and the density of the image on the tenth sheet was measured by means of a Macbeth densitometer. The difference between the maximum density and the minimum density at 9 measured points was 0.059. From the result of measurement, it was found that this comparative example was more in irregularity of the image in comparison with the case where the shape and arrangement of the cells were controlled (embodiment 11).

As described above in greater detail, according to the present invention, the shape of openings on the surface of a polyurethane foam member molded by an in-mold foaming process is properly determining and these openings are regularly arranged, making it possible to realize a foamed elastic member that can be suitably used in electrophotographic apparatus, particularly advantageously as a toner feed roller capable of providing image that is free from such defect as pitch irregularity, density irregularity or the like, and free from reduction in density.

While the present invention has been described with reference to preferred embodiments illustrated, various alterations or modifications may be made without departing from the scope of the invention.

What is claimed is:

1. A foamed elastic member comprising an elastic member made of polyurethane foam molded by an in-mold foaming process and having a plurality of openings regularly arranged in a repeatable pattern on the surface of the polyurethane foam, said openings each having a basic shape approximate to a circle, ellipse, racetrack shape, triangle, tetragon or hexagon.

2. The foamed elastic member according to claim 1, wherein said plurality of openings are arranged regularly so that, the center of each basic shape is positioned at a vertex of a square, rectangle, regular triangle or isosceles triangle.

3. The foamed elastic member according to claim 1 or 2, wherein the average equivalent diameter of said openings is 50 to 500 μm, the average distance between the centers of two openings adjacent to each other is 50 to 600 μm, and the ratio of the total area of the openings to the whole surface area of the foamed elastic member (opening ratio) is 50 to 80%.

4. The foamed elastic member according to claim 1, said foamed elastic member being molded by foaming in a mold having minute dents regularly arranged on the inner surface of it, said dents each having a basic shape of a circle, ellipse, racetrack shape, triangle, tetragon or hexagon.

5. The foamed elastic member according to claim 4, wherein the dents of the inner surface of the mold are regularly arranged so that the center of each basic shape is positioned at a vertex of a square, rectangle, regular triangle or isosceles triangle.

6. The foamed elastic member according to claim 4 or 5, wherein the average equivalent diameter of said dents of the inner surface of the mold is 50 to 500 μm, the average distance between the centers of two projections adjacent to each other is 50 to 600 μm, the height of the dents is 5 to 500 μm and the ratio of the total area of the dents to the whole area of the inner surface of the mold is 50 to 95%.

7. The foamed elastic member according to claim 1, wherein said foamed elastic member is in the shape of a roller and the compression spring constant of the surface of the roller is 0.25 to 1.5 N/mm.

8. The foamed elastic member according to claim 1, wherein said foamed elastic member is a toner feed member in a developing device.

9. A developing device comprising a foamed elastic member according to claim 1.

10. An image forming apparatus comprising a developing device according to claim 9.

11. The foamed elastic member according to claim 2, wherein the square, rectangle, regular triangle or isosceles triangle are themselves regularly arranged in a repeatable pattern.

12. The foamed elastic member according to claim 1, wherein the surface of the foamed elastic member is uncovered.

13. A toner feed roller for a developing device for electrically charging toner from a toner storage portion, feeding the toner onto the surface of a photosensitive member and forming a toner image corresponding to an electrostatic latent image on the surface of the photosensitive member, said toner feed roller comprising a foamed elastic member having a plurality of openings on its surface, said foamed elastic member being composed of polyurethane foam, and said plurality of openings being regularly arranged in a repeatable pattern on its surface, said openings each having a basic shape approximate to a circle, ellipse, racetrack shape, triangle, tetragon or hexagon.

14. The toner feed roller according to claim 13, wherein said plurality of openings are arranged regularly so that the center of each basic shape is positioned at a vertex of a square, rectangle, regular triangle or isosceles triangle.

15. The toner feed roller according to claim 13 or 14, wherein the average equivalent diameter of said openings is 50 to 500 μm, the average distance between the centers of two openings adjacent to each other is 50 to 600 μm, and the ratio of the total area of the openings to the whole surface area of the foamed elastic member (opening ratio) is 50 to 80%.

16. The toner feed roller according to claim 13, said toner feed roller being molded by foaming in a mold having minute dents regularly arranged on the inner surface of it, said dents each having a basic shape being a circle, ellipse, racetrack shape, triangle, tetragon or hexagon.

17. The toner feed roller according to claim 16, wherein the dents of the inner surface of the mold are regularly arranged so that the center of said basic shape is positioned at a vertex of a square, rectangle, regular triangle or isosceles triangle.

18. The toner feed roller according to claim 16 or 17, wherein the average equivalent diameter of said dents of the inner surface of the mold is 50 to 500 $\mu$m, the average distance between the centers of two projections adjacent to each other is 50 to 600 $\mu$m, the height of the dents is 5 to 500 $\mu$m and the ratio of the total area of the dents to the whole area of the inner surface of the mold is 50 to 95%.

19. The toner feed roller according to claim 13, wherein the compression spring constant of the surface of said foamed elastic member is 0.25 to 1.5 N/mm.

20. A developing device comprising a toner feed roller according to claim 13.

21. An image forming apparatus comprising a developing device according to claim 20.

22. The toner feed roller according to claim 14, wherein the square, rectangle, regular triangle or isosceles triangle are themselves regularly arranged in a repeatable pattern.

23. The toner feed roller according to claim 13, wherein the surface of the foamed elastic member is uncovered.

24. A foamed elastic member comprising a polyurethane foam elastic member molded by an in-mold foaming process, satisfying the following conditions:

(A) the average diameter of openings on the surface of the foamed elastic member is 50 to 300 $\mu$m, (B) the ratio of the total area of the openings to the surface area of the foamed elastic member is 50 to 80%, (C) the compression spring constant of the foamed elastic member is 0.25 to 1.5 N/mm, (D) the restoring ratio of elasticity after compression of the foamed elastic member is 60% or more, and (E) the coefficient of friction of the surface of the foamed elastic member is 0.4 to 3.0.

25. The foamed elastic member according to claim 24, wherein said conductive foamed elastic member is composed of a material having a conductive agent added to it.

26. The foamed elastic member according to claim 24, wherein said foamed elastic member is composed of polyurethane foam, and the acetone extraction ratio of said polyurethane foam is 5 weight % or less.

27. The foamed elastic member according to claim 24, wherein said foamed elastic member is a toner feed member in a developing device.

28. The developing device comprising a toner feed member according to claim 27.

29. An image forming apparatus comprising a developing device according to claim 28.

30. A toner feed roller for a developing device for electrically charging toner from a toner storage portion, feeding the toner onto the surface of a photosensitive member and forming a toner image corresponding to an electrostatic latent image on the surface of the photosensitive member, said toner feed roller comprising a foamed elastic member having a plurality of openings on its surface, said foamed elastic member satisfying the following conditions:

(A) the average diameter of the openings on the surface of the foamed elastic member is 50 to 300 $\mu$m, (B) the ratio of the total area of the openings to the surface area of the foamed elastic member is 50 to 80%, (C) the compression spring constant of the foamed elastic member is 0.25 to 1.5 N/mm, (D) the restoring ratio of elasticity after compression is 60% or more, and (E) the coefficient of friction of the surface of the foamed elastic member is 0.4 to 3.0.

31. The toner feed roller according to claim 30, wherein a conductive foamed elastic layer is formed out of said foamed elastic member, and said conductive foamed elastic layer is arranged on a shaft having an enriched conductivity.

32. The toner feed roller according to claim 30, wherein said conductive foamed elastic member is composed of a material having a conductive agent added to it.

33. The toner feed roller according to claim 30, wherein said foamed elastic member is composed of polyurethane foam, and the acetone extraction ratio of said polyurethane foam is 5 weight % or less.

34. A developing device comprising a toner feed member according to claim 30.

35. An image forming apparatus comprising a developing device according to claim 34.

36. A foamed elastic member comprising an elastic member made of polyurethane foam molded by an in-mold foaming process and having a plurality of openings regularly arranged on the surface of the polyurethane foam, said openings each having a basic shape approximate to a circle, ellipse, racetrack shape, triangle, tetragon or hexagon, wherein said foamed elastic member is in the shape of a roller and the compression spring constant of the surface of the roller is 0.25 to 1.5 N/mm.

37. A toner feed roller for a developing device for electrically charging toner from a toner storage portion, feeding the toner onto the surface of a photosensitive member and forming a toner image corresponding to an electrostatic latent image on the surface of the photosensitive member, said toner feed roller comprising a foamed elastic member having a plurality of openings on its surface, said foamed elastic member being composed of polyurethane foam having a plurality of openings regularly arranged on its surface, said openings each having a basic shape approximate to a circle, ellipse, racetrack shape, triangle, tetragon or hexagon, wherein the compression spring constant of the surface of said foamed elastic member is 0.25 to 1.5 N/mm.

* * * * *